US010254666B2

(12) United States Patent
Chiba

(10) Patent No.: US 10,254,666 B2
(45) Date of Patent: Apr. 9, 2019

(54) TONER FOR DEVELOPMENT ELECTROSTATIC IMAGES

(71) Applicant: ZEON CORPORATION, Tokyo (JP)

(72) Inventor: Takeru Chiba, Tokyo (JP)

(73) Assignee: ZEON CORPORATION, Tokyo (JP)

( * ) Notice: Subject to any disclaimer, the term of this patent is extended or adjusted under 35 U.S.C. 154(b) by 0 days.

(21) Appl. No.: 15/760,041

(22) PCT Filed: Sep. 16, 2016

(86) PCT No.: PCT/JP2016/077481
§ 371 (c)(1),
(2) Date: Mar. 14, 2018

(87) PCT Pub. No.: WO2017/057068
PCT Pub. Date: Apr. 6, 2017

(65) Prior Publication Data

US 2018/0253021 A1 Sep. 6, 2018

(30) Foreign Application Priority Data

Sep. 30, 2015 (JP) ..... 2015-193949

(51) Int. Cl.
*G03G 9/08* (2006.01)
*G03G 9/097* (2006.01)

(52) U.S. Cl.
CPC ..... *G03G 9/0819* (2013.01); *G03G 9/08* (2013.01); *G03G 9/097* (2013.01); *G03G 9/09708* (2013.01)

(58) Field of Classification Search
CPC ..... G03G 9/09708
USPC ..... 430/108.6, 108.7
See application file for complete search history.

(56) References Cited

FOREIGN PATENT DOCUMENTS

| | | | |
|---|---|---|---|
| JP | 2000-089507 | A | 3/2000 |
| JP | 2004-109716 | A | 4/2004 |
| WO | 2002-244340 | A | 8/2002 |

OTHER PUBLICATIONS

International Preliminary Report on Patentability (PCT/IB/338) dated Apr. 12, 2018, issued in PCT/JP2016/077481.

*Primary Examiner* — Mark A Chapman
(74) *Attorney, Agent, or Firm* — Westerman, Hattori, Daniels & Adrian, LLP

(57) ABSTRACT

Provided is a toner for developing electrostatic images, which is less likely to cause filming, is excellent in printing durability, and is less likely to cause fog under a high temperature and high humidity environment. The toner for developing electrostatic images is a toner containing colored resin particles that contains a binder resin, a colorant and a charge control agent, and external additives, wherein the external additives include at least: silica fine particles A, silica fine particles B, and electroconductive metal oxide fine particles C; wherein the silica fine particles. A and B are silica fine particles surface-hydrophobized with at least one hydrophobizing agent; wherein the electroconductive metal oxide fine particles C have an electrical resistance of 70 Ωcm or less and contain antimony-doped tin oxide.

4 Claims, No Drawings

TONER FOR DEVELOPMENT ELECTROSTATIC IMAGES

TECHNICAL FIELD

The present invention relates to a toner for developing electrostatic latent images formed by electrophotography, electrostatic recording, etc. More specifically, the present invention relates to a toner that is less likely to cause filming, is excellent in printing durability, and is less likely to cause fog under a high temperature and high humidity environment.

BACKGROUND ART

In image forming devices such as an electrophotographic device, an electrostatic recording device and an electrostatic printing device, a method for forming a desired image by forming an electrostatic latent image on a photoconductor and developing the image with a toner, is widely used. This method is applied to a copying machine, a printer, a facsimile machine, a multifunctional printer, etc.

For example, in an electrophotographic device using electrophotography, generally, the surface of its photoconductor comprising a photoconductive material is uniformly charged by various kinds of methods; an electrostatic latent image is formed on the photoconductor; the electrostatic latent image is developed using toner; a toner image thus obtained is transferred to a recording material such as a paper sheet; and then the toner image is fixed by heating, etc., thereby obtaining a copy.

As the toner used in image forming devices, a toner comprising colored resin particles (toner particles) is generally used, in which an external additive such as inorganic or organic fine particles having a smaller particle diameter than the toner particles, is attached to the surface of the toner particles in order to enhance toner functions such as charge stability and flowability, and obtain a desired printing performance.

However, since the charge amount of the toner is easily influenced by humidity change, there is a problem in that a change in the charge amount of the toner occurs under a high temperature and high humidity environment and causes fogging. Therefore, there is a demand for such a toner that its charge amount is less likely to decrease and is stabilized.

Patent Document 1 discloses a polymerized toner to which, as an external additive, an electroconductive metal oxide and two types of silica fine particles having different particle diameters and being hydrophobized with aminosilane and/or silicone oil are attached. However, when this toner is used in a negative charge development process, there is a problem of fogging.

CITATION LIST

Patent Document 1: Japanese Patent Application Laid-Open No. 2000-89507

SUMMARY OF INVENTION

Technical Problem

Accordingly, an object of the present invention is to provide a toner for developing electrostatic images, which is less likely to cause filming, is excellent in printing durability, and is less likely to cause fogging under a high temperature and high humidity environment.

Solution to Problem

To achieve the above object, the inventor of the present invention made diligent research and found that the above object can be achieved by a toner comprising colored resin particles and external additives including two types of specific silica fine particles and one kind of specific electroconductive metal oxide fine particles.

The present invention was achieved in light of this finding. The toner for developing electrostatic images according to the present invention comprises colored resin particles that comprises a binder resin, a colorant and a charge control agent, and external additives, wherein the external additives include at least: silica fine particles A having a number average particle diameter of from 5 nm to 19 nm, silica fine particles B having a number average particle diameter of from 20 nm to 200 nm, and electroconductive metal oxide fine particles C having a number average particle diameter of from 0.05 to 1 μm; wherein the silica fine particles A and B are silica fine particles surface-hydrophobized with at least one hydrophobizing agent selected from the group consisting of a hydrophobizing agent containing an amino group, a silane coupling agent and a silicone oil; wherein the electroconductive metal oxide fine particles C have an electrical resistance of 70 Ωcm or less and contain antimony-doped tin oxide; and wherein, with respect to 100 parts by mass of the colored resin particles, a content of the silica fine particles A is from 0.1 to 2.0 parts by mass; a content of the silica fine particles B is from 0.1 to 3.0 parts by mass; and a content of the electroconductive metal oxide fine particles C is from 0.1 to 1.0 part by mass.

For the toner for developing electrostatic images according to the present invention, a blow-off charge amount of the electroconductive metal oxide fine particles C is preferably from −50 to −3000 μC/g.

For the toner for developing electrostatic images according to the present invention, the electroconductive metal oxide fine particles C are preferably silicon dioxide fine particles covered with the antimony-doped tin oxide.

For the toner for developing electrostatic images according to the present invention, the colored resin particles, the silica fine particles A and the silica fine particles B are preferably positively chargeable.

Advantageous Effects of Invention

A toner is provided according to the present invention, which is less likely to cause filming, is excellent in printing durability, and is less likely to cause fog under a high temperature and high humidity environment.

DESCRIPTION OF EMBODIMENTS

The toner for developing electrostatic images according to the present invention comprises colored resin particles that comprises a binder resin, a colorant and a charge control agent, and external additives, wherein the external additives include at least: silica fine particles A having a number average particle diameter of from 5 nm to 19 nm, silica fine particles B having a number average particle diameter of from 20 nm to 200 nm, and electroconductive metal oxide fine particles C having a number average particle diameter of from 0.05 to 1 μm; wherein the silica fine particles A and B are silica fine particles surface-hydrophobized with at least one hydrophobizing agent selected from the group consisting of a hydrophobizing agent containing an amino group, a silane coupling agent and a silicone oil; wherein the electroconductive metal oxide fine particles C have an electrical resistance of 70 Ωcm or less and contain antimony-doped tin oxide; and wherein, with respect to 100 parts by mass of the colored resin particles, a content of the silica fine particles A is from 0.1 to 2.0 parts by mass; a content of the silica fine particles B is from 0.1 to 3.0 parts by mass; and a content of the electroconductive metal oxide fine particles C is from 0.1 to 1.0 part by mass.

As described above, the toner of the present invention comprises the colored resin particles and the external additives. In the present invention, generally, the external additives are attached to or partly embedded in the colored resin particles. Part of the external additives may be detached from the colored resin particles.

The external additives constituting the toner of the present invention include the silica fine particles A having a number average particle diameter of from 5 nm to 19 nm, the silica fine particles B having a number average particle diameter of from 20 nm to 200 nm, and the electroconductive metal oxide fine particles C having a number average particle diameter of from 0.05 to 1 μm. Hereinafter, the external additives will be described in detail.

The number average particle diameter of the silica fine particles A is from 5 nm to 19 nm, and preferably from 6 to 15 nm. A toner with excellent flowability and transferability can be obtained by using the silica fine particles A having a number average particle diameter in this range.

The silica fine particles A are silica fine particles surface-hydrophobized with at least one hydrophobizing agent selected from the group consisting of a hydrophobizing agent containing an amino group, a silane coupling agent and a silicone oil.

As the hydrophobizing agent containing the amino group, examples include, but are not limited to, a silicon compound containing an amino group.

The silicon compound containing the amino group is not limited to a particular compound, and various kinds of compounds can be used. As the silicon compound containing the amino group, examples include, but are not limited to, an amino group-containing silane coupling agent, an amino-modified silicone oil, a quaternary ammonium salt type silane, and a cyclic silazane represented by the following formula (1). Of them, the amino group-containing silane coupling agent and the cyclic silazane represented by the following formula (1) are particularly preferred from the viewpoint of positively charging ability and flowability. As the amino group-containing silane coupling agent, examples include, but are not limited to, N-2(aminoethyl)3-aminopropylmethyldimethoxysilane, N-2(aminoethyl)3-aminopropyltrimethoxysilane, 3-aminopropyltrimethoxysilane, 3-aminopropyltriethoxysilane, and N-phenyl-3-aminopropyltriethoxysilane. Of such coupling agents, the coupling agent containing the aminoalkyl group is preferred from the point of view that the effect of increasing the stability of charging performance in an environmental change is excellent.

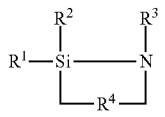

(1)

In the formula (1), $R^1$ and $R^2$ are independently selected from the group consisting of hydrogen, halogen, alkyl, alkoxy and aryloxy; $R^3$ is selected from the group consisting of hydrogen, $—(CH_2)_nCH_3$, $—C(O)(CH_2)_nCH_3$, $—C(O)NH_2$, $—C(O)NH(CH_2)_nCH_3$ and $—C(O)N[(CH_2)_nCH_3](CH_2)_mCH_3$ (where n and m are each an integer of 0 to 3); and $R^4$ is represented by $[(CH_2)_a(CHX)_b(CHY)_c]$ (where X and Y are independently selected from the group consisting of hydrogen, halogen, alkyl, alkoxy and aryloxy, and a, b and c are each an integer of from 0 to 6 which satisfies such a condition that the sum of a, b and c (a+b+c) is equal to an integer of from 2 to 6).

As the silane coupling agent (except one containing an amino group), examples include, but are not limited to, disilazanes such as hexamethyldisilazane, and alkylsilane compounds such as trimethylsilane, trimethylchlorosilane, dimethyldichlorosilane, methyltrichlorosilane, allyldimethylchlorosilane, benzyldimethylchlorosilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-butyltrimethoxysilane, n-hexadecyltrimethoxysilane, n-octadecyltrimethoxysilane, vinyltrimethoxysilane, vinyltriethoxysilane, γ-methacryloxypropyltrimethoxysilane, and vinyltriacetoxysilane. As the silicone oil (except one containing an amino group), examples include, but are not limited to, dimethylpolysiloxane, methylhydrogenpolysiloxane, methylphenylpolysiloxane, and modified silicone oil.

These silane coupling agents may be used alone or in combination of two or more kinds. Of the silane coupling agents, hexamethyldisilazane (HMDS) is preferred.

For the silica fine particles A, the hydrophobicity measured by a methanol method is generally from 30 to 98%, preferably from 50 to 95%, and more preferably from 60 to 90%. When the hydrophobicity is smaller than 30%, there is a large influence by the environment. Especially, a decrease in charge occurs at high temperature and high humidity, and fogging may easily occur. On the other hand, when the hydrophobicity is larger than 98%, an increase in charge occurs at low temperature and low humidity and may cause a decrease in image density.

With respect to 100 parts by mass of the colored resin particles, the content of the silica fine particles A is from 0.1 to 2.0 parts by mass, and preferably from 0.2 to 1.0 part by mass. When the content of the silica fine particles A is below the range, a decrease in flowability occurs and causes fogging or transfer failure. On the other hand, when the content of the silica fine particles A is above the range, an increase in charge amount occurs at low temperature and low humidity and causes print soiling or fixing failure.

The number average particle diameter of the silica fine particles B is from 20 nm to 200 nm, and preferably from 25 to 100 nm. When the silica fine particles B are not used, a decrease in toner flowability occurs and causes an increase in fogging or print soiling or a decrease in cleaning properties.

The silica fine particles B are silica fine particles surface-hydrophobized with the same hydrophobizing agent as the above-mentioned the silica fine particles A. The hydrophobizing agent used for the surface hydrophobization of the silica fine particles A may be the same type as or a different type from the hydrophobizing agent used for the surface hydrophobization of the silica fine particles B. The hydrophobizing agent preferably used for the surface treatment of the silica fine particles B, is the same as the case of the silica fine particles A.

The hydrophobicity of the silica fine particles B is generally from 10 to 95%, preferably from 20 to 90%, and more preferably from 30 to 85%. When the hydrophobicity is smaller than 10%, there is a large influence by the environment. Especially, a decrease in charge occurs at high temperature and high humidity, and fogging may easily occur. On the other hand, when the hydrophobicity is larger than 95%, an increase in charge occurs at low temperature and low humidity and may cause a decrease in image density.

With respect to 100 parts by mass of the colored resin particles, the content of the silica fine particles B is from 0.1 to 3.0 parts by mass, and preferably from 0.5 to 2.0 parts by mass. When the content of the silica fine particles B is below the range, a decrease in cleaning properties occurs. On the other hand, when the content of the silica fine particles B is above the range, print soiling or fixing failure occurs at low temperature and low humidity.

All of the silica fine particles A, the silica fine particles B and the colored resin particles are preferably positively chargeable. As just described, since the colored resin particles and the two external additives are positively chargeable, the thus-obtained toner is a positively chargeable toner.

The number average particle diameter of the electroconductive metal oxide fine particles C is from 0.05 to 1 μm, and preferably from 0.1 to 0.5 μm. When the particle diameter is within the range, the toner can obtain appropriate charge properties under a wide range of temperature environments and humidity environments.

The electrical resistance of the electroconductive metal oxide fine particles C is 70 Ωcm or less, preferably from 0.1 to 60 Ωcm, and more preferably from 1 to 40 Ωcm. When the electrical resistance of the electroconductive metal oxide fine particles C is more than 70 Ωcm, an increase in charge amount occurs at low temperature and low humidity and causes a decrease in image density. When the electrical resistance of the electroconductive metal oxide fine particles C is smaller than 0.1 Ωcm, a decrease in charge amount occurs at high temperature and high humidity and may cause fogging.

The electroconductive metal oxide fine particles C contain antimony-doped tin oxide. As the fine particles containing antimony-doped tin oxide, examples include, but are not limited to, titanium oxide fine particles surface treated with tin oxide doped with antimony, such as EC-100, EC-210 and EC-300E (product names) manufactured by Titan Kogyo, Ltd., ET300W, ET500W, ET600W, HJ-1 and HI-2 (product names) manufactured by Ishihara Sangyo Kaisha, Ltd., and W-P (product name, manufactured by JEMCO Inc.), silicon dioxide fine particles surface-treated with tin oxide doped with antimony, such as ES-650E (product name, manufactured by Titan Kogyo, Ltd.), and tin-antimony composite oxide fine particles such as EC-900 (product name, manufactured by Titan Kogyo, Ltd.) and T-1 (product name, manufactured by JEMCO Inc.)

Of them, the electroconductive metal oxide fine particles C are preferably the silicon dioxide fine particles covered with the antimony-doped tin oxide.

The blow-off charge amount of the electroconductive metal oxide fine particles C is preferably from −50 to −3000 μC/g, and more preferably from −500 to −2500 μC/g. When the blow-off charge amount of the electroconductive metal oxide fine particles C is more than −50 μC/g (less than 50 in absolute value), a toner charging function is less likely to be exhibited, and severe initial fog may occur at high temperature and high humidity. On the other hand, when the blow-off charge amount of the electroconductive metal oxide fine particles C is less than −3000 μC/g (more than 3000 in absolute value), severe electrostatic aggregation of the external additive particles or severe attachment of the external additive particles to the members of a printer occurs and may cause severe filming.

With respect to 100 parts by mass of the colored resin particles, the content of the electroconductive metal oxide fine particles C is from 0.1 to 1.0 part by mass, and preferably from 0.2 to 0.9 part by mass. When the content of the electroconductive metal oxide fine particles C is below the range, fogging occurs under a low temperature and low humidity environment or a high temperature and high humidity environment. On the other hand, when the content of the electroconductive metal oxide fine particles C is larger than the range, these fine particles are released from the colored resin particles and soil the members of a printer.

In the present invention, only the silica fine particles A, the silica fine particles B and the electroconductive metal oxide fine particles C may be used as the external additives, or fine particles that have been used as an external additive may be further used in addition to them. As such an external additive, examples include, but are not limited to, inorganic fine particles and organic fine particles. As the inorganic fine particles, examples include, but are not limited to, aluminum oxide, titanium oxide, zinc oxide, tin oxide, cerium oxide, silicon nitride, calcium carbonate, calcium phosphate, barium titanate, and strontium titanate. As the organic fine particles, examples include, but are not limited to, methacrylic acid ester polymer particles, acrylic acid ester polymer particles, styrene-methacrylic acid ester copolymer particles, styrene-acrylic acid ester copolymer particles, core-shell type particles in which the core is formed with a styrene polymer and the shell is formed with a methacrylic acid ester polymer, and melamine resin particles.

The colored resin particles constituting the toner of the present invention are particles that contain at least the binder resin, the colorant and the charge control agent. Preferably, the colored resin particles further contain a release agent. As needed, the colored resin particles may further contain a magnetic material, etc.

As the binder resin, examples include, but are not limited to, resins that have been widely used in toners, such as polystyrene, styrene-butyl acrylate copolymer, polyester resin and epoxy resin.

As the colorant, examples include, but are not limited to, carbon black, titanium black, magnetic powder, oil black, titanium white, and all kinds of colorants and dyes. As the carbon black (black), one having a primary particle diameter of from 20 to 40 nm is preferably used. This is because, since the particle diameter is in this range, the carbon black can be uniformly dispersed in the toner, and fogging is less likely to occur.

To obtain a full color toner, a yellow colorant, a magenta colorant and a cyan colorant are generally used.

As the yellow colorant, examples include, but are not limited to, compounds such as an azo-based colorant and a condensed polycyclic colorant. As the compounds, examples include, but are not limited to, C.I. Pigment Yellow 3, 12, 13, 14, 15, 17, 62, 65, 73, 83, 90, 93, 97, 120, 138, 155, 180, 181, 185 and 186.

As the magenta colorant, examples include, but are not limited to, compounds such as an azo-based colorant and a condensed polycyclic colorant. As the compounds, examples include, but are not limited to, C.I. Pigment Red 31, 48, 57, 58, 60, 63, 64, 68, 81, 83, 87, 88, 89, 90, 112, 114, 122, 123, 144, 146, 149, 150, 163, 170, 184, 185, 187, 202, 206, 207, 209 and 251, and C.I. Pigment Violet 19.

As the cyan colorant, examples include, but are not limited to, a copper phthalocyanine compound and derivatives thereof, and an anthraquinone compound. As the compounds and derivatives, examples include, but are not limited to, C.I. Pigment Blue 2, 3, 6, 15, 15:1, 15:2, 15:3, 15:4, 16, 17 and 60.

The amount of the colorant is preferably from 1 to 10 parts by mass, with respect to 100 parts by mass of the binder resin.

As the release agent, examples include, but are not limited to, polyolefin waxes such as low-molecular-weight polyethylene, low-molecular-weight polypropylene and low-molecular-weight polybutylene; natural plant waxes such as candelilla wax, carnauba wax, rice wax, Japan wax and jojoba wax; petroleum waxes and modified waxes thereof, such as paraffin wax, microcrystalline wax, and petrolatum; synthetic waxes such as Fischer-Tropsch wax; and polyfunctional ester compounds such as pentaerythritol tetramyristate, pentaerythritol tetrapalmitate, and dipentaerythritol hexamyristate.

These release agents may be used alone or in combination of two or more kinds.

Of these release agents, the synthetic waxes and the polyfunctional ester compounds are preferred. Of them, preferred is such a polyfunctional ester compound that in a DSC curve measured by a differential scanning calorimeter, the endothermic peak temperature in temperature increase is in a range of preferably from 30 to 150° C., more preferably from 40 to 100° C., and most preferably from 50 to 80° C. This is because a toner with an excellent balance between fixing and releasability can be obtained. More preferred is a polyfunctional ester compound which has a molecular weight of 1000 or more, which is dissolved in an amount of 5 parts by mass or more at 25° C. with respect to 100 parts by mass of styrene, and which has an acid value of 10 mgKOH/g or less. This is because this polyfunctional ester compound is remarkably effective in decreasing toner fixing temperature. As such a polyfunctional ester compound, pentaerythritol tetramyristate is particularly preferred. The "endothermic peak temperature" means a value measured in accordance with ASTM D 3418-82.

The amount of the release agent is generally from 3 to 20 parts by mass, and preferably from 5 to 15 parts by mass, with respect to 100 parts by mass of the binder resin.

The toner of the present invention contains the charge control agent. As the charge control agent, a charge control agent has been used in toners, can be used without any limitation. In the present invention, a positively chargeable charge control agent is preferably used.

The amount of the charge control agent is generally from 0.01 to 30 parts by mass, and preferably from 0.03 to 25 parts by mass, with respect to 100 parts by mass of the binder resin.

The colored resin particles may be so-called core-shell type (or "capsule type") particles obtained by combining two different polymers as the inside (core layer) and outside (shell layer) of the particles. The core-shell type particles are preferred since they can achieve a balance between lowering of fixing temperature and prevention of aggregation during storage by covering the inside (core layer) composed of a substance having a low softening point with a substance having a higher softening point.

In general, the core layer of the core-shell type particles is composed of the binder resin, the colorant, the charge control agent and the release agent, and the shell layer thereof is composed of only the binder resin.

The mass ratio of the core layer and the shell layer of the core-shell type particles is not particularly limited. It is generally from 80/20 to 99.9/0.1 (the core layer/the shell layer).

By controlling the shell layer ratio to the above ratio, the toner can obtain both storage stability and low-temperature fixability.

The average thickness of the shell layers of the core-shell type particles is considered to be generally from 0.001 to 0.1 μm, preferably from 0.003 to 0.08 μm, and more preferably from 0.005 to 0.05 μm. As the thickness increases, the fixability of the toner may decrease. As the thickness decreases, the storage stability of the toner may decrease. When the colored resin particles are core-shell type particles, the surface of the core particles constituting the core-shell colored resin particles is not needed to be wholly covered with the shell layer. The surface of the core particles may be partly covered with the shell layer.

For the core-shell type particles, when the core particle diameter and the shell layer thickness can be observed with an electron microscope, they can be obtained by directly measuring the size of a particle randomly selected from particles shown in an image taken by the electron microscope, and directly measuring the thickness of the shell layer of the particle. When it is difficult to observe the core and shell with the electron microscope, the core particle diameter and the shell layer thickness can be calculated from the particle diameter of the core particle and the amount of a monomer used to form the shell in toner production.

For the colored resin particles constituting the toner of the present invention, the volume average particle diameter Dv is preferably from 3 to 10 μm, and more preferably from 4 to 9.5 μm. When the Dv is less than 3 μm, toner flowability decreases and may decrease transferability, cause blur, or decrease image density. When the Dv is more than 10 μm, image resolution may decrease.

For the colored resin particles constituting the toner of the present invention, the ratio (Dv/Dn) between the volume average particle diameter (Dv) and the number average particle diameter (Dn) is preferably from 1.0 to 1.3, and more preferably from 1.0 to 1.28. When the ratio Dv/Dn is more than 1.3, blur or a decrease in transferability, image density and resolution may occur. The volume average particle diameter and number average particle diameter of the toner can be measured by means of Multisizer (product name, manufactured by Beckman Coulter, Inc.), for example.

For the colored resin particles constituting the toner of the present invention, the average circularity is from 0.94 to 0.995, and preferably from 0.95 to 0.99. When the average circularity is less than 0.94, a decrease in transferability occurs.

The average circularity can be relatively easily controlled in the range, by producing the colored resin particles by a phase inversion emulsion method, a solution suspension method, a polymerization method or the like.

In the present invention, "circularity" is defined as a value obtained by dividing the perimeter of a circle having the same area as the projected area of a particle image by the perimeter of the particle image. Also in the present invention, "average circularity" is used as a simple method for quantitatively representing the shape of the particles and is an indicator that shows the degree of the surface roughness of the toner. The average circularity is 1 when the toner is perfectly spherical, and it gets smaller as the surface shape of the colored resin particles becomes more complex.

The average circularity (Ca) is a value obtained by the following formula:

$$\text{Average circularity } (Ca) = \left(\sum_{i=1}^{n} (Ci \times f\ i)\right) / \sum_{i=1}^{n} (f\ i)$$

In the above formula, n is the number of particles for each of which the circularity Ci was obtained.

In the above formula, Ci is the circularity of each of particles having an equivalent circle diameter of from 0.6 to 400 μm and is calculated by the following formula based on the perimeter measured for each particle:

Circularity (*Ci*)=(The perimeter of a circle having the same area as the projected area of a particle image)/(The perimeter of the projected particle image)

In the above formula, fi is the frequency of the particles having the circularity Ci.

The circularity and the average circularity can be measured by means of flow particle image analyzer "FPIA-1000" or "FPIA-2000" (product name, manufactured by Sysmex Corporation).

The method for producing the colored resin particles is not particularly limited. The polymerization method is preferred since the above-described circularity can be easily obtained.

Next, the method for producing the colored resin particles by the polymerization method will be described in detail. The colored resin particles constituting the toner of the present invention can be obtained as follows: the colorant, the charge control agent and other additives are dissolved or dispersed in a polymerizable monomer, which is a raw material for the binder resin; in an aqueous dispersion medium containing a dispersion stabilizer, the thus-obtained mixture or dispersion is polymerized by adding a polymerization initiator thereto and, as needed, particles thus produced are associated with each other; then, the particles are recovered from the mixture or dispersion by filtration, and then washed, dehydrated and dried, thereby producing the colored resin particles.

As the polymerizable monomer, examples include, but are not limited to, a monovinyl monomer, a crosslinkable monomer and a macromonomer. The polymerizable monomer is polymerized into a binder resin component.

As the monovinyl monomer, examples include, but are not limited to, aromatic vinyl monomers such as styrene, vinyltoluene and α-methylstyrene; (meth)acrylic acid; (meth)acrylic copolymers such as methyl (meth)acrylate, ethyl (meth)acrylate, propyl (meth)acrylate, butyl (meth) acrylate, 2-ethylhexyl (meth)acrylate, cyclohexyl (meth) acrylate, and isobornyl (meth)acrylate; and monoolefin monomers such as ethylene, propylene and butylene.

These monovinyl monomers may be used alone or in combination of two or more kinds. Of them, it is preferable to use the aromatic vinyl monomer alone or to use a combination of the aromatic vinyl monomer and the (meth) acrylic monomer.

Hot offset is effectively reduced by using a crosslinkable monomer in combination with the monovinyl monomer. The crosslinkable monomer is a monomer containing two or more vinyl groups. As the crosslinkable monomer, examples include, but are not limited to, divinylbenzene, divinylnaphthalene, ethylene glycol dimethacrylate, pentaerythritol triallyl ether, and trimethylolpropane triacrylate. These crosslinkable monomers may be used alone or in combination of two or more kinds. The amount of the crosslinkable monomer is generally 10 parts by mass or less, and preferably from 0.1 to 2 parts by mass, with respect to 100 parts by mass of the monovinyl monomer.

As the polymerization initiator, examples include, but are not limited to, persulfates such as potassium persulfate and ammonium persulfate; azo compounds such as 4,4'-azobis (4-cyanovaleric acid), 2,2'-azobis(2-methyl-N-(2-hydroxyethyl)propionamide, 2,2'-azobis(2-amidinopropane) dihydrochloride, 2,2'-azobis(2,4-dimethylvaleronitrile) and 2,2'-azobisisobutyronitrile; and peroxides such as di-t-butyl peroxide, benzoyl peroxide, t-butylperoxy-2-ethylhexanoate, t-hexylperoxy-2-ethylhexanoate, t-butyl peroxypivalate, di-isopropyl peroxydicarbonate, di-t-butylperoxy isophthalate, and t-butylperoxy isobutyrate. Also, a redox initiator (a combination of the polymerization initiator with a reducing agent) may be used.

The amount of the polymerization initiator used for the polymerization of the polymerizable monomer is preferably from 0.1 to 20 parts by mass, more preferably from 0.3 to 15 parts by mass, and most preferably from 0.5 to 10 parts by mass, with respect to 100 parts by mass of the polymerizable monomer. The polymerization initiator may be added to a polymerizable monomer composition in advance or, in some cases, the polymerization initiator may be added to the aqueous dispersion medium subjected to droplets formation.

In the polymerization, a dispersion stabilizer is preferably added to the aqueous dispersion medium. As the dispersion stabilizer, examples include, but are not limited to, metal compounds including sulfates such as barium sulfate and calcium sulfate, carbonates such as barium carbonate, calcium carbonate and magnesium carbonate, phosphates such as calcium phosphate, metal oxides such as aluminum oxide and titanium oxide, and metal hydroxides such as aluminum hydroxide, magnesium hydroxide and iron(II)hydroxide; water-soluble polymers such as polyvinyl alcohol, methyl cellulose and gelatin; and surfactants such as an anionic surfactant, a nonionic surfactant and an ampholytic surfactant. These dispersion stabilizers may be used alone or in combination of two or more kinds.

Of the above dispersion stabilizers, the dispersion stabilizer containing a colloid of a metal compound, especially a hardly water-soluble inorganic hydroxide, is preferred since the polymer particles can have a narrow particle size distribution, and the amount of the dispersion stabilizer remaining after washing can be small, so that the polymerization toner thus obtained can clearly reproduce an image.

For the colloid of the hardly water-soluble metal hydroxide, the number particle size distribution is preferably as follows: the particle diameter that the number-based cumulative total reckoned from the small particle diameter side is 50% (Dp50) is 0.5 μm or less and, as with the above, the particle diameter that the number-based cumulative total reckoned from the small particle diameter side is 90% (Dp90) is 1 μm or less. As the particle diameter of the colloid increases, polymerization stability is reduced and may decrease toner stability.

The amount of the dispersion stabilizer is preferably from 0.1 to 20 parts by mass, with respect to 100 parts by mass of the polymerizable monomer. When the amount of the dispersion stabilizer is less than 0.1 part by mass, it is difficult to obtain sufficient polymerization stability, and a polymerer aggregate may be easily produced. On the other hand, when the amount of the dispersion stabilizer is more than 20 parts by mass, the particle diameter of the polymerized toner becomes too small and may not be suitable for practical use.

It is preferable to use a molecular weight modifier in the polymerization. As the molecular weight modifier, examples include, but are not limited to, mercaptans such as t-dodecyl mercaptan, n-dodecyl mercaptan, n-octyl mercaptan and 2,2,4,6,6-pentamethylheptane-4-thiol. The molecular weight modifier may be added before or during the polymerization. The amount of the molecular weight modifier is preferably from 0.01 to 10 parts by mass, and more preferably from 0.1 to 5 parts by mass, with respect to 100 parts by mass of the polymerizable monomer.

The method for producing the above-mentioned, preferred core-shell type colored resin particles is not particularly limited. The core-shell type colored resin particles can be produced by a conventional method. As the method, examples include, but are not limited to, a spray dry method, an interface reaction method, an in situ polymerization method and a phase separation method. In particular, the core-shell type colored resin particles are obtained as follows: the colored resin particles obtained by a pulverization method, a polymerization method, an association method or a phase inversion emulsion method, are used as the core particles, and they are each covered with a shell layer, thereby obtaining the core-shell type colored resin particles. Of these production methods, the in situ polymerization method and the phase separation method are preferred from the viewpoint of production efficiency.

The method for producing the capsule type colored resin particles containing a core-shell structure by the in situ polymerization method, will be described below.

The capsule type colored resin particles containing a core-shell structure, can be obtained by adding a polymerizable monomer for forming a shell (a polymerizable monomer for shell) and a polymerization initiator to an aqueous dispersion medium in which core particles are dispersed, and then polymerizing the mixture.

As the method for forming the shell, examples include, but are not limited to, a method for adding the polymerizable monomer for shell to a reaction system of a polymerization reaction developed for obtaining the core particles, and continuously polymerizing the polymerizable monomer for shell, and a method for adding the polymerizable monomer for shell to core particles obtained in a different reaction system and polymerizing the polymerizable monomer for shell.

The polymerizable monomer for shell may be added to the reaction system at once or may be added continuously or intermittently to the reaction system by means of a pump such as a plunger pump.

As the polymerizable monomer for shell, monomers that can form a polymer having a glass transition temperature of more than 80° C., such as styrene, acrylonitrile and methyl methacrylate, can be used alone or in combination of two or more kinds.

A water-soluble polymerization initiator is preferably added at the time of adding the polymerizable monomer for shell, since the capsule type colored resin particles containing a core-shell structure can be easily obtained. By adding the water-soluble polymerization initiator at the time of adding the polymerizable monomer for shell, it is considered that the water-soluble polymerization initiator moves to the vicinity of the outer surface of the core particles, to which the polymerizable monomer for shell moved, and a polymer (shell) can be easily formed on the core particle surface.

As the water-soluble polymerization initiator, examples include, but are not limited to, persulfates such as potassium persulfate and ammonium persulfate, and azo-based initiators such as 2,2'-azobis(2-methyl-N-(2-hydroxyethyl)propionamide) and 2,2'-azobis-(2-methyl-N-(1,1-bis(hydroxymethyl)2-hydroxyethyl)propionamide). The amount of the water-soluble polymerization initiator is generally from 0.1 to 50 parts by mass, and preferably from 1 to 30 parts by mass, with respect to 100 parts by mass of the polymerizable monomer for shell.

The polymerization temperature is preferably 50° C. or more, and more preferably from 60 to 95° C. The reaction time is preferably from 1 to 20 hours, and more preferably from 2 to 10 hours. After the polymerization is completed, the colored resin particles obtained by the polymerization is preferably subjected to repeated operations of filtering, washing, dehydrating and drying several times as needed, according to a conventional method.

When an inorganic compound such as an inorganic hydroxide is used as the dispersion stabilizer, preferably, the dispersion stabilizer is dissolved in water by adding acid or alkali to the aqueous dispersion of the colored resin particles obtained by the polymerization, and then the dispersion stabilizer is removed. When a colloid of a hardly water-soluble inorganic hydroxide is used as the dispersion stabilizer, the pH of the aqueous dispersion is preferably controlled to 6.5 or less by adding acid. As the acid, examples include, but are not limited to, inorganic acids such as sulfuric acid, hydrochloric acid and nitric acid, and organic acids such as formic acid and acetic acid. Sulfuric acid is particularly preferred for its high removal efficiency and small impact on production facilities.

The method for filtering the colored resin particles from the aqueous dispersion medium and dehydrating them is not particularly limited. As the method, examples include, but are not limited to, a centrifugal filtration method, a vacuum filtration method and a pressure filtration method. Of them, the centrifugal filtration method is preferred.

The toner of the present invention is obtained by mixing the colored resin particles, the external additives and, as needed, other fine particles by means of a high-speed stirrer such as Henschel Mixer.

EXAMPLES

Hereinafter, the present invention will be described further in detail, with reference to examples and comparative examples. The scope of the present invention may not be limited to the following examples. Herein, "part(s)" and "%" are based on mass if not particularly mentioned.

In the following examples and comparative examples, methods for measuring and evaluating properties are as follows.

(1) Measurement of Particle Diameter of Colored Resin Particles

The volume average particle diameter Dv, number average particle diameter Dn and particle diameter distribution Dv/Dn of colored resin particles were measured by a particle diameter measuring device (product name: Multisizer, manufactured by: Beckman Coulter). This measurement by Multisizer was carried out under the following conditions: aperture diameter: 100 μm, dispersion medium: Isoton II (product name), concentration: 10%, and the number of measured particles: 100,000 particles.

Specifically, 0.2 g of sample colored resin particles were put into a beaker, and an aqueous alkylbenzene sulfonate solution (product name: DryWell, manufactured by: Fujifilm Corporation) was added thereto as a dispersant. In addition, a dispersion medium (2 mL) was added thereto to wet the colored resin particles; the dispersion medium (10 mL) was further added thereto; the mixture was dispersed with an ultrasonic dispersion machine for 1 minute; then, the resulting dispersion was measured by the above-mentioned particle diameter measuring device.

(2) Measurement of Blow-Off Charge Amount of Electroconductive Metal Oxide Fine Particles C First, 9.95 g of a carrier (product name: NZ-3, manufactured by: Powdertech Corporation) and 0.05 g of a sample (the electroconductive metal oxide fine particles C) were weighed out and put in a 100 cc glass bottle. The bottle was rotated for 30 minutes at a rotational frequency of 150 rpm. Then, using a blow-off meter (product name: TB-203, manufactured by: Toshiba Chemical Corporation), the blow-off charge amount of the mixture in the glass bottle was measured by blowing nitrogen gas at a pressure of 4.5 kPa and suctioning the gas at a pressure of 9.5 kPa. The measurement was carried out at a temperature of 23° C. and a relative humidity of 50%.

(3) Printing Durability

In a printing durability test, a commercially-available, non-magnetic one-component development printer (HL-4570CDW) was used. The toner cartridge of the development device was filled with the toner. Then, printing sheets were loaded in the device.

The printer was left for 24 hours under a normal temperature and normal humidity (N/N) environment (temperature: 23° C., humidity: 50%). Then, under the same environment, 15,000 sheets were continuously printed at an image density of 5%.

Solid pattern printing (image density 100%) was carried out every 500 sheets, and the resulting black solid images were measured for image density by means of a reflection image densitometer (product name: RD918, manufactured by: Macbeth). Then, another solid pattern printing (image density 0%) was carried out. When printing halfway, the printer was stopped. A piece of an adhesive tape (product name: Scotch Mending Tape 810-3-18, manufactured by: Sumitomo 3M Limited) was attached to a non-image area on the photoconductor of the printer after development to attach the toner in the area thereto. Then, the tape piece was removed therefrom and attached to a printing sheet. Next, the whiteness degree (B) of the printing sheet on which the tape piece was attached, was measured with a whiteness colorimeter (product name: ND-1, manufactured by: Nippon Denshoku Industries Co., Ltd.) In the same manner, an unused piece of the adhesive tape was attached to the printing sheet, and the whiteness degree (A) was measured. The difference in whiteness degree (A-B) was determined as a fog value. As the fog value gets smaller, fog decreases and a better result is obtained.

The number of continuously printed sheets that could maintain such an image quality that the image density is 1.3 or more and the fog value is as described below, was measured. The fog value at the time of printing the first sheet was determined as the initial fog value.

(4) Filming Evaluation

In the same manner as above, 14,000 sheets were continuously printed. Every 500 sheets, the photoconductor was visually observed to check the presence of filming. The number of sheets on which filming was found, was determined as the number of sheets on which filming occurred.

(5) Fog Evaluation Under High Temperature and High Humidity (H/H) Environment

A commercially-available, non-magnetic one-component development printer (HL-3040CN) was used. The toner cartridge of the development device was filled with the toner. Then, the printer was left for 24 hours under a high temperature and high humidity (H/H) environment (temperature: 35° C., humidity: 80%). Then, the print speed of the printer was reduced by half. At the reduced print speed, solid pattern printing (image density 0%) was carried out on one sheet, and the sheet was visually observed to check the presence of fog. Then, using a whiteness colorimeter (manufactured by: Nippon Denshoku Industries Co., Ltd.), the whiteness degree of the solid pattern-printed area on the sheet was measured. A fog density was calculated by the following formula:

$$\text{Fog degree}=\{(\text{Whiteness degree before printing})-(\text{Whiteness degree after printing}\})$$

(6) Minimum Fixing Temperature

A fixing test was carried out by using a commercially-available, non-magnetic one-component development printer modified so that the temperature of its fixing roll can be varied. The fixing test was carried out by printing a solid pattern (image density: 100%) and varying the temperature of the fixing roll of the modified printer in steps of 5° C. to measure the fixing rate of the toner at each temperature, thereby finding a relationship between the temperature and the fixing rate. The fixing rate was calculated from the ratio of image densities before and after a peeling operation using a piece of tape, which was carried out on a solid pattern-printed area (image density: 100%) on a test paper sheet. Specifically, assuming that the image density before the peeling of the tape piece is ID (before), and the image density after the peeling thereof is ID (after), the fixing rate can be calculated by the following Calculation Formula 1.

$$\text{Fixing rate (\%)}=(\text{ID(after)}/\text{ID(before)})\times 100 \quad \text{Calculation Formula 1:}$$

The peeling operation using the tape is a series of the following operations: a piece of an adhesive tape (product name: Scotch Mending Tape 810-3-18, manufactured by: Sumitomo 3M Limited) is applied to a measuring area on a test paper sheet; the tape piece is attached to the sheet by pressing the tape piece at a fixed pressure; and the attached tape piece is then peeled at a fixed rate in a direction along the paper sheet. The image density was measured by means of a reflection image densitometer (product name: RD914, manufactured by: McBeth Co.) In this fixing test, the minimum temperature of the fixing roll at which the fixing rate of the toner was more than 80%, was defined as the minimum fixing temperature of the toner.

(7) Solid Followability

In the same manner as above, the toner cartridge of the printer was filled with the toner, and the printer was left under a normal temperature and normal humidity (N/N) environment for one day. Then, solid pattern printing (image density 100%) was carried out on 10 sheets. Using a reflection image densitometer (product name: RD918, manufactured by: Macbeth), the image density of a part of the solid pattern printed on the 10th sheet, which is a part below 50 mm from the top edge of the pattern, and the image density of another part of the solid pattern printed on the 10th sheet, which is a part above 50 mm from the bottom edge of the pattern, were measured. The difference between the image densities was determined as the indicator of solid followability. As the difference between the image densities gets smaller, the solid followability gets better.

Example 1

First, 83 parts of styrene, 17 parts of n-butyl acrylate, 7 parts of carbon black (product name: #25B, manufactured by: Mitsubishi Chemical Corporation, primary particle diameter: 40 nm), 0.03 part of a charge control agent (product name: N1, manufactured by: Orient Chemical Industries, Ltd.), 0.6 part of divinylbenzene, 1.5 parts of t-dodecyl mercaptan, and 5 parts of pentaerythritol tetramyristate were dispersed at room temperature by means of a bead mill to obtain a uniformly mixed solution. While stirring the mixed solution, 5 parts of t-butylperoxy-2-ethylhexanoate was added thereto. The stirring was continued until the mixed solution became a uniformly mixed solution.

Separately, an aqueous solution of 4.8 parts of sodium hydroxide (alkali metal hydroxide) dissolved in 50 parts of ion-exchanged water, was gradually added to an aqueous solution of 9.5 parts of magnesium chloride (water-soluble polyvalent metal salt) dissolved in 250 parts of ion-exchanged water, while stirring at room temperature, thereby preparing a magnesium hydroxide colloid (hardly water-soluble metal hydroxide colloid) dispersion. The polymerizable monomer composition was added to the colloid dispersion. Using T. K. Homomixer, the colloid dispersion containing the resulting polymerizable monomer mixture was subjected to high shear agitation at 12,000 rpm, thereby forming the polymerizable monomer mixture into droplets. The resulting aqueous dispersion in which the droplets of the polymerizable monomer mixture were dispersed, was put in a reactor furnished with agitating blades. A polymerization reaction of the mixture was initiated at 90° C. and continued for 8 hours. Then, the reactor was cooled down, and an aqueous dispersion of colored resin particles was obtained.

The aqueous dispersion of the colored resin particles was subjected to acid washing in the following manner: while agitating the aqueous dispersion, the pH of the aqueous dispersion was controlled to 4 or less by adding sulfuric acid.

Then, water was separated from the aqueous dispersion by filtration, and the thus-obtained solid was re-slurried with 500 parts of ion-exchanged water and subjected to water washing. Next, dehydration and water washing were repeatedly carried out several times again, and a solid was separated by filtration. The solid was dried with a dryer at 45° C. for one day, thereby obtaining colored resin particles. For the colored resin particles, the volume average particle diameter was 9.5 μm; the volume average particle diameter (Dv)/the number average particle diameter (Dn) was 1.28; and the average circularity was 0.984 (almost spherical).

To 100 parts of the above-obtained colored resin particles, the following three types of external additives were added.

Silica fine particles a (product name: TG820F, man ufactured by: Cabot Corporation) Number average particle diameter: 8 nm Amount added: 0.6 part ilica fine particles b (product name: NA50Y, manu factured by: Nippon Aerosil Co., Ltd.)
Number average particle diameter: 35 nm
Amount added: 1.0 part Electroconductive metal oxide fine particles c1 (product name: ES-650E, manufactured by: Titan Kog yo, Ltd.)
Base material: Silicon dioxide
Cover layer: Antimony-doped tin oxide
Number average particle diameter: 0.33 μm
Electrical resistance: 30 Ωcm
Blow-off charge amount: −2200 μC/g
Amount added: 0.3 part The colored resin particles and the three types of the external additives were mixed with a 10 L Henschel Mixer for 2.5 minutes at a rotational frequency of 1400 rpm, thereby obtaining a toner. This is the toner of Example 1.

Examples 2 to 10 and Comparative Examples 1 to 6

Toners of Examples 2 to 10 and Comparative Examples 1 to 6 were produced in the same manner as Example 1, except that the types and/or amounts of the external additives were changed as shown in Tables 1 and 2.

In the following Tables 1 and 2, "Silica a", "Silica b" and "Oxide c1" mean the silica fine particles a, the silica fine particles b and the electroconductive metal oxide fine particles c1, respectively. In the following Table 1, "Oxide c2" means the following electroconductive metal oxide fine particles c2:

Electroconductive metal oxide fine particles c2 (product name: EC-300E, manufactured by: Titan Kog yo, Ltd.)
Base material: Titanium dioxide
Cover layer: Antimony-doped tin oxide
Number average particle diameter: 0.3 μm
Electrical resistance: 40 Ωcm
Blow-off charge amount: −430 μC/g

TABLE 1

| | | Example 1 | Example 2 | Example 3 | Example 4 | Example 5 |
|---|---|---|---|---|---|---|
| Silica fine particles A | Type | Silica a | Silica a | Silica a | Silica a | Silica a |
| | Number average particle diameter (nm) | 8 | 8 | 8 | 8 | 8 |
| | Content (part) | 0.6 | 0.6 | 0.6 | 0.6 | 0.6 |
| Silica fine particles B | Type | Silica b | Silica b | Silica b | Silica b | Silica b |
| | Number average particle diameter (nm) | 35 | 35 | 35 | 35 | 35 |
| | Content (part) | 1.0 | 1.0 | 1.0 | 1.0 | 1.0 |
| Electroconductive metal oxide fine particles C | Type | Oxide c1 | Oxide c1 | Oxide c1 | Oxide c2 | Oxide c2 |
| | Number average particle diameter (μm) | 0.33 | 0.33 | 0.33 | 0.30 | 0.30 |

TABLE 1-continued

| | | | | | | |
|---|---|---|---|---|---|---|
| | Electrical resistance (Ωcm) | 30 | 30 | 30 | 40 | 40 |
| | Blow-off charge amount (μC/g) | −2200 | −2200 | −2200 | −430 | −430 |
| | Content (part) | 0.3 | 0.1 | 0.9 | 0.3 | 0.1 |
| Minimum fixing temperature (° C.) | | 160 | 160 | 165 | 160 | 155 |
| Initial fog at high temperature and high humidity | | 0.2 | 0.1 | 0.6 | 1.5 | 1.2 |
| Filming (Sheets) | | 15000< | 15000< | 12000 | 15000< | 15000< |
| Printing durability (Sheets) | | 15000< | 12000 | 15000< | 14000 | 11000 |
| Solid followability | | 0.0 | 0.1 | 0.3 | 0.0 | 0.2 |

| | | Example 6 | Example 7 | Example 8 | Example 9 | Example 10 |
|---|---|---|---|---|---|---|
| Silica fine particles A | Type | Silica a | Silica a | Silica a | Silica a | Silica a |
| | Number average particle diameter (nm) | 8 | 8 | 8 | 8 | 8 |
| | Content (part) | 0.6 | 0.1 | 1.2 | 0.6 | 0.6 |
| Silica fine particles B | Type | Silica b | Silica b | Silica b | Silica b | Silica b |
| | Number average particle diameter (nm) | 35 | 35 | 35 | 35 | 35 |
| | Content (part) | 1.0 | 1.0 | 1.0 | 0.1 | 2.0 |
| Electroconductive metal oxide fine particles C | Type | Oxide c2 | Oxide c1 | Oxide c1 | Oxide c1 | Oxide c1 |
| | Number average particle diameter (μm) | 0.30 | 0.33 | 0.33 | 0.33 | 0.33 |
| | Electrical resistance (Ωcm) | 40 | 30 | 30 | 30 | 30 |
| | Blow-off charge amount (μC/g) | −430 | −2200 | −2200 | −2200 | −2200 |
| | Content (part) | 0.9 | 0.3 | 0.3 | 0.3 | 0.3 |
| Minimum fixing temperature (° C.) | | 165 | 150 | 165 | 150 | 165 |
| Initial fog at high temperature and high humidity | | 2.0 | 0.3 | 1.0 | 0.3 | 1.0 |
| Filming (Sheets) | | 12000 | 15000< | 10000 | 15000< | 10000 |
| Printing durability (Sheets) | | 15000< | 13000 | 15000< | 10000 | 15000< |
| Solid followability | | 0.3 | 0.4 | 0.1 | 0.3 | 0.4 |

TABLE 2

| | | Comparative Example 1 | Comparative Example 2 | Comparative Example 3 | Comparative Example 4 | Comparative Example 5 | Comparative Example 6 |
|---|---|---|---|---|---|---|---|
| Silica fine particles A | Type | — | Silica a | Silica a | Silica a | Silica a | Silica a |
| | Number average particle diameter (nm) | — | 8 | 8 | 8 | 8 | 8 |
| | Content (part) | — | 2.4 | 0.6 | 0.6 | 0.6 | 0.6 |
| Silica fine particles B | Type | Silica b | Silica b | — | Silica b | Silica b | Silica b |
| | Number average particle | 35 | 35 | — | 35 | 35 | 35 |

TABLE 2-continued

| | | Comparative Example 1 | Comparative Example 2 | Comparative Example 3 | Comparative Example 4 | Comparative Example 5 | Comparative Example 6 |
|---|---|---|---|---|---|---|---|
| | diameter (nm) | | | | | | |
| | Content (part) | 1.0 | 1.0 | — | 4.0 | 1.0 | 1.0 |
| Electroconductive metal oxide fine particles C | Type | Oxide c1 | Oxide c1 | Oxide c1 | Oxide c1 | — | Oxide c1 |
| | Number average particle diameter (μm) | 0.33 | 0.33 | 0.33 | 0.33 | — | 0.33 |
| | Electrical resistance (Ωcm) | 30 | 30 | 30 | 30 | — | 30 |
| | Blow-off charge amount (μC/g) | −2200 | −2200 | −2200 | −2200 | — | −2200 |
| | Content (part) | 0.3 | 0.3 | 0.3 | 0.3 | — | 1.5 |
| Minimum fixing temperature (° C.) | | 150 | 175 | 150 | 175 | 160 | 170 |
| Initial fog at high temperature and high humidity | | 0.3 | 2.5 | 1.7 | 0.5 | 3.5 | 1.5 |
| Filming (Sheets) | | 15000< | 6000 | 8000 | 12000 | 15000< | 3000 |
| Printing durability (Sheets) | | 10000 | 13000 | 7000 | 14000 | 9000 | 14000 |
| Solid followability | | 0.7 | 0.1 | 0.2 | 0.6 | 0.1 | 0.3 |

5. Overall Evaluation of Toners

The toner of Comparative Example 1 is a toner comprising the silica fine particles b in combination with the electroconductive metal oxide fine particles c1 as the external additives. For the toner of Comparative Example 1, the value of the solid flowability is as high as 0.7. This value is the highest among all of the experiment toners. Therefore, it is clear that poor solid flowability is obtained when the silica fine particles A having a number average particle diameter of from 5 nm to 19 nm are not used.

The toner of Comparative Example 2 is a toner comprising, in addition to the silica fine particles b and the electroconductive metal oxide fine particles c1, 2.4 parts of the silica fine particles a as the external additives. For the toner of Comparative Example 2, there is no problem with the solid flowability. However, the minimum fixing temperature is as high as 175° C.; the value of the initial fog at high temperature and high humidity is as high as 2.5; and the filming evaluation sheets number is as small as 6,000. Especially, the minimum fixing temperature of Comparative Example 2 is the highest among all of the experiment toners. Therefore, it is clear that when the silica fine particles A having a number average particle diameter of from 5 nm to 19 nm are used in an amount of more than 2.0 parts with respect to 100 parts of the colored resin particles, poor low temperature fixability is obtained; initial fog is likely to occur under the high temperature and high humidity (H/H) environment; and filming is likely to occur.

The toner of Comparative Example 3 is a toner comprising the electroconductive metal oxide fine particles c1 in combination with the silica fine particles a as the external additives. For the toner of Comparative Example 3, the filming evaluation sheets number is as small as 8,000, and the printing durability evaluation sheets number is as small as 7,000. Especially, the printing durability evaluation sheets number is the smallest among all of the experiment toners. Therefore, it is clear that when the silica fine particles B having a number average particle diameter of from 20 nm to 200 nm are not used, filming is likely to occur, and poor printing durability is obtained.

The toner of Comparative Example 4 is a toner comprising, in addition to the electroconductive metal oxide fine particles c1 and the silica fine particles a, 4.0 parts of the silica fine particles b as the external additives. For the toner of Comparative Example 4, there is no problem with the filming and the printing durability. However, the minimum fixing temperature is as high as 175° C., and the value of the solid flowability is as high as 0.6. Especially, the minimum fixing temperature of Comparative Example 4 is the highest among all of the experiment toners. Therefore, it is clear that when the silica fine particles B having a number average particle diameter of from 20 nm to 200 nm are used in an amount of more than 3.0 parts with respect to 100 parts of the colored resin particles, poor low temperature fixability and poor solid flowability are obtained.

The toner of Comparative Example 5 is a toner comprising the silica fine particles a in combination with the silica fine particles b as the external additives. For the toner of Comparative Example 5, the value of the initial fog under the high temperature and high humidity (H/H) environment is as high as 3.5, and the printing durability evaluation sheets number is as small as 9,000. Especially, the value of the initial fog under the high temperature and high humidity (H/H) environment is the highest among all of the experiment toners. Therefore, it is clear that when the electroconductive metal oxide fine particles C having a number average particle diameter of from 0.05 to 1 μm are not used, initial fog is likely to occur under the high temperature and high humidity (H/H) environment, and poor printing durability is obtained.

The toner of Comparative Example 6 is a toner comprising, in addition to the silica fine particles a and the silica fine particles b, 1.5 parts of the electroconductive metal oxide fine particles c1 as the external additives. For the toner of Comparative Example 6, there is no problem with the printing durability and the initial fog under the high temperature and high humidity (H/H) environment. However, the minimum fixing temperature is as high as 170° C., and the filming evaluation sheets number is as small as 3,000. Especially, the filming evaluation sheets number of Comparative Example 6 is the smallest among all of the experiment toners. Therefore, it is clear that when the electroconductive metal oxide fine particles C having a number average particle diameter of from 0.05 to 1 μm are used in an amount of more than 1.0 part with respect to 100 parts of the colored resin particles, poor low temperature fixability is obtained, and filming is likely to occur.

The toners of Examples 1 to 10 are each a toner comprising, with respect to 100 parts of the colored resin particles, 0.1 to 1.2 parts of the silica fine particles a, 0.1 to 2.0 parts of the silica fine particles b, and 0.1 to 0.9 part of the electroconductive metal oxide fine particles c1 or c2.

For the toners of Examples 1 to 10, the minimum fixing temperature is as low as 165° C.; the value of the initial fog under the high temperature and high humidity (H/H) environment is as small as 2.0 or less; the filming evaluation shests number and the printing durability evaluation sheets number are each as large as 10,000 or more; and the value of the solid flowability is as small as 0.4 or less.

Therefore, it is clear that the toners of Examples 1 to 10 each comprising the three types of the external additives in the specific amounts, are toners which are less likely to cause filming, which are excellent in printing durability, and which are less likely to cause fog even under the high temperature and high humidity environment.

The invention claimed is:

1. A toner for developing electrostatic images, comprising colored resin particles that comprises a binder resin, a colorant and a charge control agent, and external additives, wherein the external additives include at least:

silica fine particles A having a number average particle diameter of from 5 nm to 19 nm, silica fine particles B having a number average particle diameter of from 20 nm to 200 nm, and electroconductive metal oxide fine particles C having a number average particle diameter of from 0.05 to 1 μm;

wherein the silica fine particles A and B are silica fine particles surface-hydrophobized with at least one hydrophobizing agent selected from the group consisting of a hydrophobizing agent containing an amino group, a silane coupling agent and a silicone oil;

wherein the electroconductive metal oxide fine particles C have an electrical resistance of 70 Ωcm or less and contain antimony-doped tin oxide; and wherein, with respect to 100 parts by mass of the colored resin particles, a content of the silica fine particles A is from 0.1 to 2.0 parts by mass; a content of the silica fine particles B is from 0.1 to 3.0 parts by mass; and a content of the electroconductive metal oxide fine particles C is from 0.1 to 1.0 part by mass.

2. The toner for developing electrostatic images according to claim 1, wherein a blow-off charge amount of the electroconductive metal oxide fine particles C is from −50 to −3000 μC/g.

3. The toner for developing electrostatic images according to claim 1, wherein the electroconductive metal oxide fine particles C are silicon dioxide fine particles covered with the antimony-doped tin oxide.

4. The toner for developing electrostatic images according to claim 1, wherein the colored resin particles, the silica fine particles A and the silica fine particles B are positively chargeable.

* * * * *